US005833054A

United States Patent [19]

Graves

[11] Patent Number: 5,833,054

[45] Date of Patent: Nov. 10, 1998

[54] KEY CASE ASSEMBLY WITH SELECT FEATURE

[76] Inventor: Jodie B Graves, 718 SE. 41st St., Lawton, Okla. 73501

[21] Appl. No.: 790,361

[22] Filed: Jan. 28, 1997

[51] Int. Cl.[6] ..... A45C 11/32

[52] U.S. Cl. ..... 206/38.1; 206/37.4; 206/37.6

[58] Field of Search ..... 206/38, 38.1, 576, 206/37, 37.4, 37.6, 37.7, 806, 37.1

[56] References Cited

U.S. PATENT DOCUMENTS

| | | | |
|---|---|---|---|
| 2,155,014 | 4/1939 | Howe | 206/37.4 |
| 2,541,333 | 2/1951 | Campbell | 206/37.4 |
| 4,417,612 | 11/1983 | Couture et al. | 206/37.4 |
| 5,363,680 | 11/1994 | Wu | 206/37.6 X |

*Primary Examiner*—Jacob K. Ackun

*Attorney, Agent, or Firm*—Alfred Hoyte, Jr.

[57] ABSTRACT

A key case is provided which allows for the exclusive selection of individual keys. The case has a plurality of compartments capable of holding one or two keys. The compartments may be zippered or have an access door. In a first embodiment the main body of the case is made out of leather or fabric. Each key compartment is accessed by way of a zipper which allows for the keys to be selectively available for manipulation by the user. In another embodiment the case is rigid and has an access door for each compartment. Opening the access door allows access to the keys. In both embodiments the key is attached to the interior of the key compartments by a relatively long chain which allows the user to use the key while the key case is still attached to the users belt, purse, etc. The case is provided with a velcro patch which allows it to be secured to vertical surfaces such as the dashboard of an automobile.

12 Claims, 9 Drawing Sheets

10

100

KEY CASE ASSEMBLY WITH SELECT FEATURE

BACKGROUND OF THE INVENTION

1. Field of the Invention

The present invention relates to keychains and key cases. More specifically, it relates to improved key cases which allow for selecting individual keys one at a time.

2. Description of the Prior Art

As will be seen, the simplicity and effectiveness of my invention is not rivaled in the prior art.

U.S. Pat. No. 3,354,678 issued to Stifleman discloses a key case having a select feature. Individual keys may be selected by depressing plungers which are connected to each key. A cable interconnects all the plungers so that extension of one key causes retraction of another. By contrast, the present invention is relatively simple in construction and relies on gravity as opposed to a complex mechanism.

U.S. Pat. No. 4,706,803 issued to Wang discloses a key selector device which allows for selecting of individual keys. The device is relatively large compared to the size of the keys and uses a complex cam action actuator to select the individual. By contrast, the present invention contemplates a key case with a selector feature that is relatively small with respect to the size of the keys.

U.S. Pat. No. 2,287,521 issued to Handley discloses a key case having a selector feature. The key case can hold only four keys and has a large surface area which renders the device bulky and cumbersome. By contrast, the device of the present invention can hold up to 8 keys and is relatively compact.

U.S. Pat. No. 2,602,320 issued to Lane discloses a key case having a selector device. The device uses a plunger and cam assembly to partially eject the key. By contrast, the device of the present invention is relatively simple and uses a single moving piece to select the desired key.

None of the above inventions and patents, taken either singly or in combination, is seen to describe the instant invention as claimed.

SUMMARY OF THE INVENTION

Briefly, the invention comprises a key case which allows for the exclusive selection of individual keys. The case has a plurality of compartments capable of holding one or two keys. The compartments may be zippered or have an access door. In a first embodiment the main body of the case is made out of leather or fabric. Each key compartment is accessed by way of a zipper which allows for the keys to be selectively available for manipulation by the user. In another embodiment the case is rigid and has an access door for each compartment. Opening the access door allows access to the keys. In both embodiments the key is attached to the interior of the key compartments by a relatively long chain, cord, or other flexible connector which allows the user to use the key while the key case is still attached to the users belt, purse, etc. The case is provided with a velcro patch which allows it to be secured to vertical surfaces such as the dashboard of an automobile.

Accordingly, it is a principal object of the invention to provide a new and improved key case assembly.

It is a major object of this invention to provide a key case assembly capable of exclusively selecting individual keys.

It is another object of the invention to provide such an improved key case assembly having a single moving part for selecting the keys.

It is still another object of the invention to provide an improved key case assembly of relatively small size.

It is another object of the invention to provide an improved key case assembly having a plurality of storage pockets.

It is another object of the invention to provide an improved key case assembly attachment means for attaching the assembly to a vertical surface.

It is another object of the invention to provide an improved key case assembly having an elastic cord attached to the keys to allow for extension of the key.

It is another object of the invention to provide an improved key case assembly having illumination means to allow for identification of the keys in low light conditions.

It is another object of the invention to provide an improved key case assembly having raised numbers or other indicia for indicating the position of the keys.

It is another object of the invention to provide an improved key case assembly which can hold up to 8 keys.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
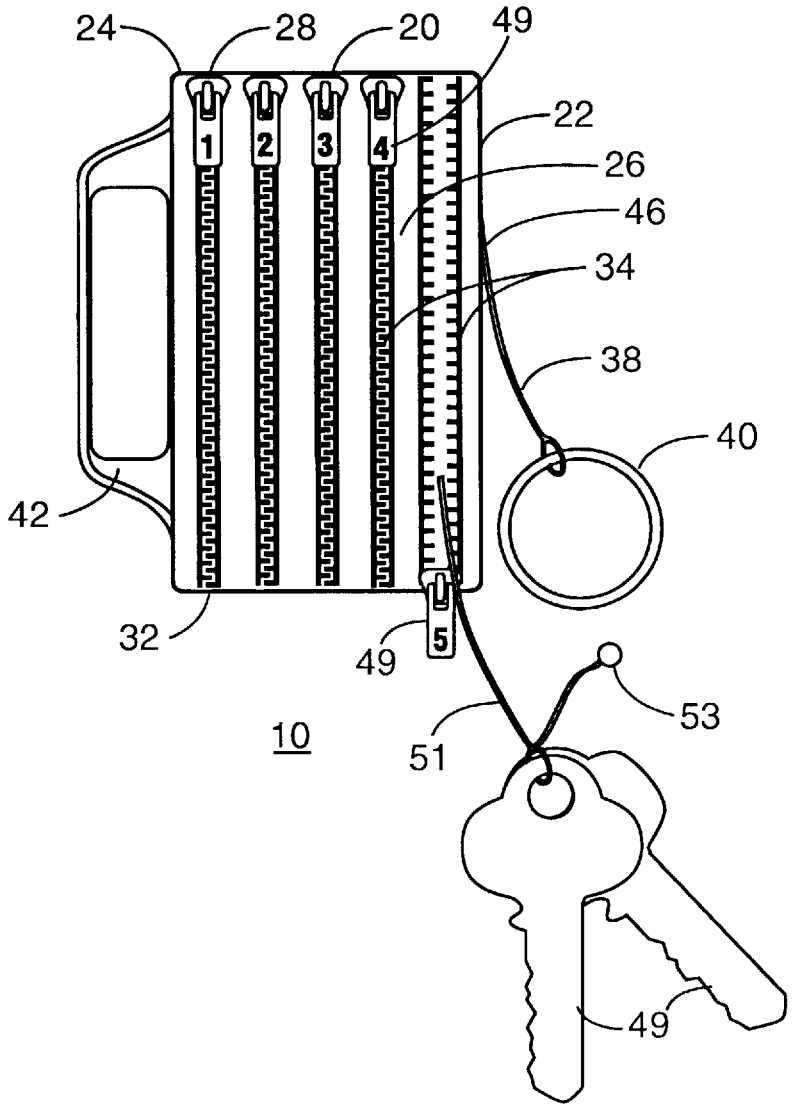
FIG. 1 is a front view of the assembly of the present invention.
Figure 2:
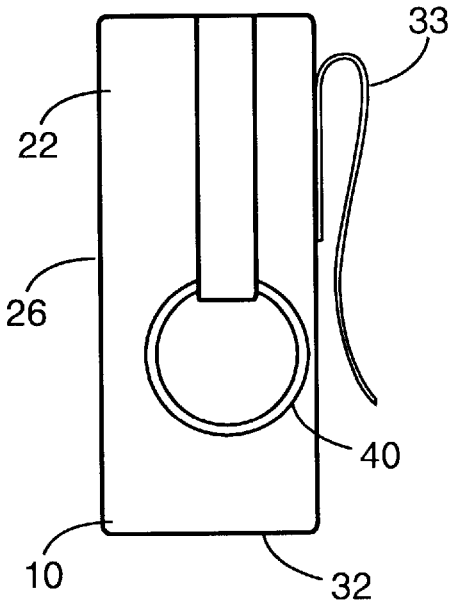
FIG. 2 is a side view of the assembly of the present invention.

Referring now to FIGS. 1–5, several views of the key case assembly of the present invention, generally indicated by the numeral 10, is shown. The assembly 10 has a housing 20 having opposing side panels 22, 24, a zippered front 26, a top panel 28, and rear 30 and bottom 32 panels. A plurality of zippers 34 function as key selectors as will be explained in more detail later.

Figure 3:
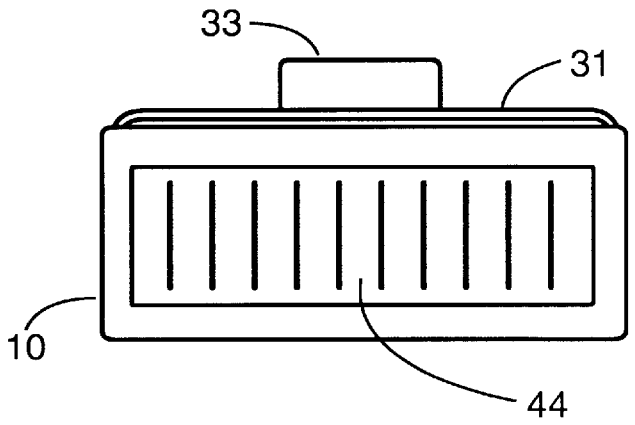
FIG. 3 is a top view of the assembly of the present invention.

The side panel 22 includes a key chain 38 and associated key ring 40 which is securely attached thereto. The key chain 38 and key ring 40 allow the assembly 10 to be attached to a larger key ring. Of course extra keys may be attached to the key ring 40. The opposite side 24 has an elastic strap 42 secured thereto. The elastic strap 42 is adapted to secure any small flat objects such as, e.g., a remote control garage door opener or a remote alarm controller. An additional strap 44 may be secured to the top panel 28 as shown in FIG. 3. This strap 44 allows for handy carrying of the assembly 10.

The front 26 has a plurality of zippers 34 which allow access to a plurality of compartments 46 within which the keys 48 are contained. The compartments 46 may contain one or two keys 48. Each of the zippers 34 has a tab 49 for opening and closing the zipper 34, the tab 49 having numerals or other indicia imprinted or embossed thereon. Preferably, the tab 49 is flourescent so that it has a glow in the dark capability. In additions to the numerals the tab 49 may have braille imprinted thereon. The keys 48 are attached to the case 20 by a cord 51 which may be made of very coarse string, elastic, or leather. The most frequently used keys 48 may have an additional length of cord 51 attached thereto which terminates in a knot 53. The knot 53 may be allowed to extend outwardly of the case 20 so that the user can grasp the knot 53 and thereby remove the key 48. This allows the user to readily identify the most frequently used key by feel without having to look at the case 20.

Figure 4:
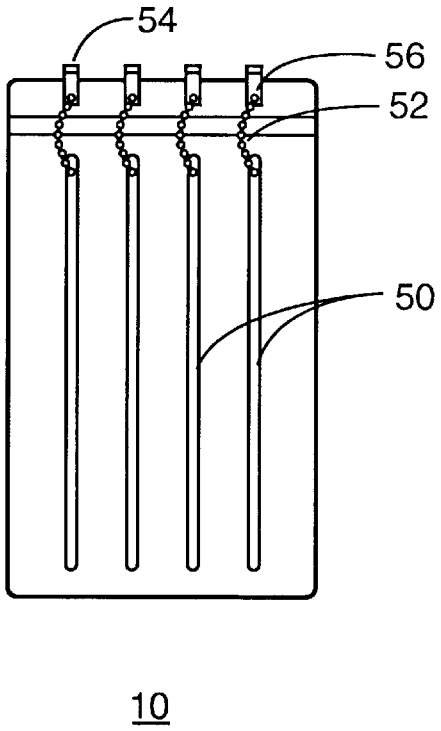
FIG. 4 is a front view of an alternative embodiment of the assembly of the present invention.

In lieu of zippers 34, the front 26 may be made of rubber as is shown in the alternative embodiment of FIG. 4. A plurality of vertical slits 50 formed in the front 26 panel allow for selective removal of the keys 48. Each of the slits 50 has a pair of overlapping flaps such as those found on rubberized change purses. It should be noted that the housing 20 may be made of any flexible, durable material such as leather, fabric, vinyl, or any of several suitable plastics as may be apparent to one skilled in the art. The rear panel 30 has a pocket 31 secured thereto. The pocket 31 may be used to hold a drivers license or other flat, relatively thin objects. Secured to the exterior of the pocket 31 is a clip 33 which may be attached to the users clothing. Additionally, a belt loop (not shown) may be attached to any of the exterior panels.

Figure 5:
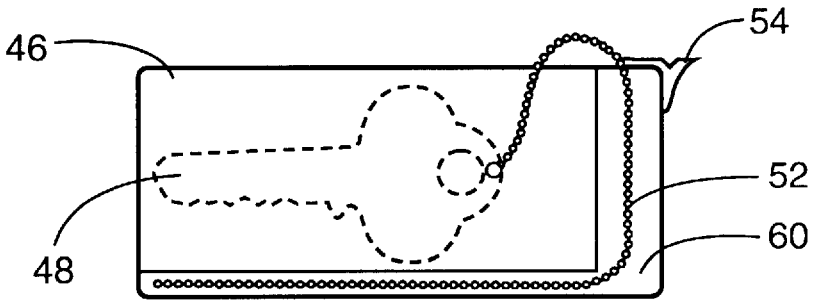
FIG. 5 is a partially broken away side view of FIG. 4.
Figure 6:
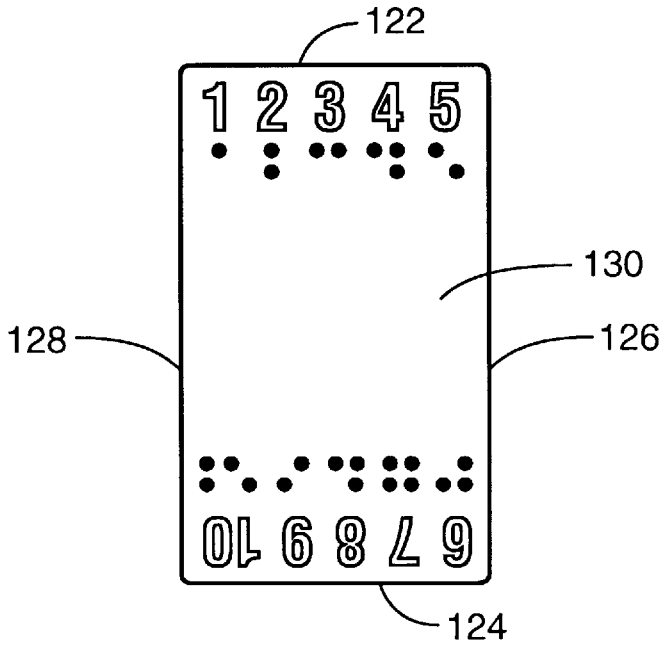
FIG. 6 is a rear view of a third embodiment of the present invention.
Figure 7:
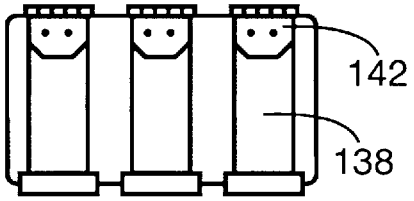
FIG. 7 is a bottom view of the embodiment shown in FIG. 6.
Figure 8:
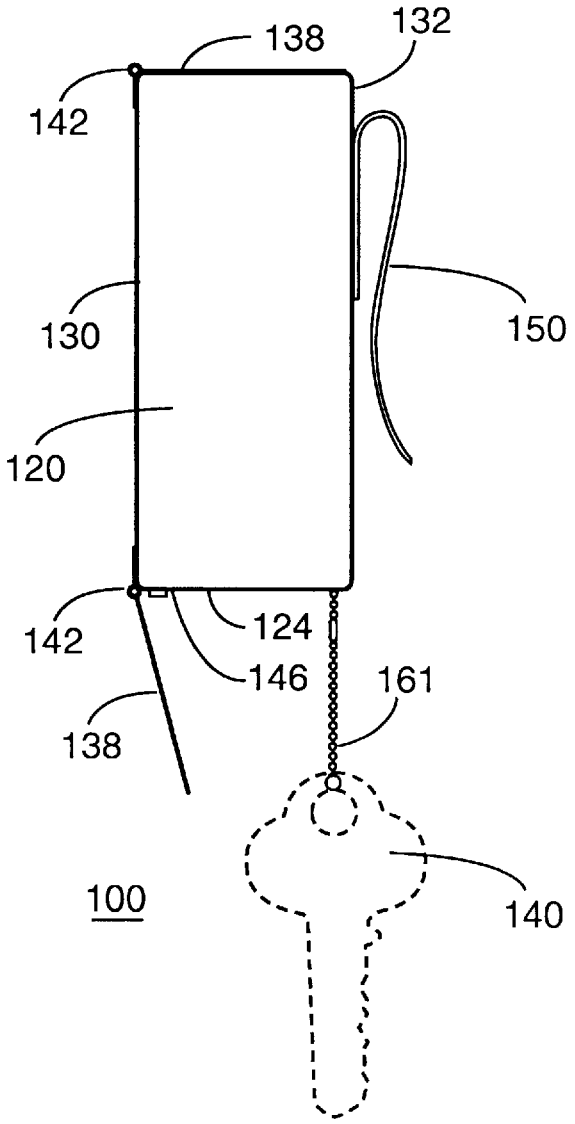
FIG. 8 is a side view of the embodiment shown in FIG. 6.
Figure 9:
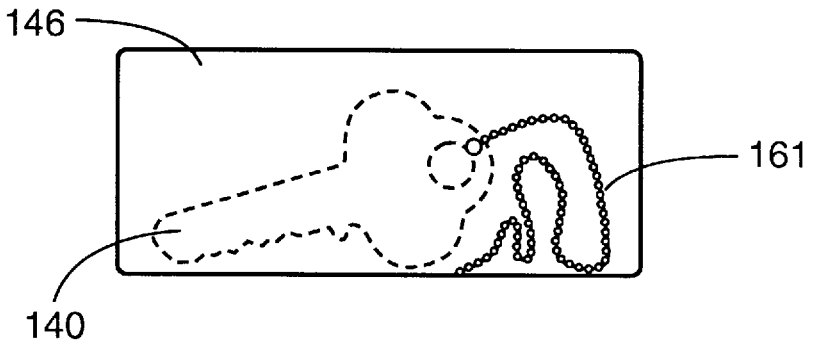
FIG. 9 is a cross-section of the embodiment shown in FIG. 6.

The keys 48 are attached to a corresponding plurality of key chains 52 which allow for extension of the keys 48 from the housing 20. As can be seen in FIGS. 4 and 5, a plurality of key chain retainers 54, one for each key chain 52 are provided. The retainers 54 allow for selective extension of the key chain 52 from the housing 20. Each of the retainers 54 has an opening 56 of variable size. The retainer 54 is spring loaded and is biased in the normally closed position as shown in FIG. 4. In this position, the key chain 52 cannot pass through the small portion of the opening. When the retainer 54 is lifted as shown in FIG. 5, the chain 52 can pass through the large portion of the opening 56 and thus the selected key 48 may be extended. The chain 52 may be replaced by an elastic cord. It can be seen that there is storage space 60 above and behind each of the compartments 46 for the extra length of key chain 52.

An alternative embodiment of the assembly 10 is shown in FIGS. 6–9. This embodiment, generally indicated by the numeral 100, has a rigid housing 120. The housing 120 may be made of any rigid material, but a lightweight durable plastic is preferred. The housing 120 has top 122 and bottom 124 panels, opposing side panels 126, 128, a front panel 130, and rear panel 132. Both the top 122 and bottom 124 panels have a plurality of doors 138 which may be opened or closed to allow for selecting the desired key 140. The doors 138 may be connected to the housing 120 via hinges 142. Alternatively, the doors 138 may slide in and out of the housing 120 via tracks (not shown).

It should be mentioned here that the key retainer arrangement described above in connection with embodiment of FIGS. 4 and 5 may be incorporated into the present embodiment. The retainers may be attached to the underside of the doors 138, and a key chain 161 may be threaded therethrough. Thus the door 138 may be opened but the key 140 can only extend when the retainer releases the key chain 161.

The doors 138 correspond to internal slots 146 within which the keys 140 are contained. As in the first embodiment, one or two keys 140 may be contained within the slots 146. Both the top 122 and bottom 124 panels have doors 138 formed therein, the doors 138 being offset in the horizontal direction. Thus, for example, the door 138 in panel 122 for the slot 146 corresponding to number 1 as printed on the housing, is physically offset in the horizontal direction from the door 138 in panel 124 corresponding to the numeral 10. It can be readily appreciated that the slots 146 corresponding to numeral 1 and 10 are adjacent.

Preferably, the numerals on the rear panel 132 are flourescent or otherwise illuminated so that they can be visualized in the dark. Additionally, braille characters are provided to facilitate use by the blind or visually impaired.

The rear panel 132 has a clip 150 removably attached thereto. Preferably, the clip 150 is attached by a hook and loop type fastener (not shown). Thus the clip 150 may be removed and the rear panel 132 may be attached to any surface having a hook and loop type fastener. One application which may be facilitated by this arrangement is in an automobile. It is well known that the weight of a key chain can have adverse effects on the ignition switch of an automobile. Indeed, excessively heavy key chains have been known render an ignition switch inoperable prematurely. By attaching the rear panel 132 to the dashboard of a vehicle, none of the weight of the key chain is supported by the ignition switch. Thus in lieu of the clip 150, the hook and loop type fastener which secures the clip 150 may be attached to a mating hook and loop type fastener which is secured to the dashboard. With the clip 150 secured to the housing 120, the keys 140 may be extended from the housing 120 with the clip 150 secured, e.g., to the user's belt. A similar clip arrangement may be provided for the assembly 10 of the first embodiment.

In operation, the desired key 48, 140 is selected using the appropriate mechanism, i.e., the zipper 34 in the first embodiment, the retainer 54 in the second embodiment, and the door 138 in the third embodiment. The key 48, 140 is extracted from the housing 20, 120 by gravity, or by manipulation by the user. The key 48, 140 is then used as required. The user may then place the key 48, 140 back in the appropriate slot so that another key may be selected.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A key case assembly for storing a plurality of keys so that any one key may be selectively extended therefrom comprising:

a generally hollow housing having a top, a pair of opposing side panels, a bottom panel, and a rear panel;

said hollow housing having a plurality of compartments formed therein, each compartment containing at least one key, said at least one key being attached within said compartment by a connector of relatively long length;

a plurality of zippers, each of said zippers allowing access to one of said compartments so that said keys may be selectively and exclusively removed from said compartment.

2. The assembly of claim 1 including indicia for enumerating said slots.

3. The assembly of claim 2 including means for illuminating said indicia.

4. The assembly of claim 1 including a pocket secured to said rear panel.

5. The assembly of claim 1 where said connector has a knot formed at one end, said knot being extensible from said housing.

6. A key case assembly for storing a plurality of keys so that any one key may be selectively extended therefrom comprising:

a generally hollow, rigid housing having a top, a pair of opposing side panels, a bottom panel, and a rear panel;

said hollow housing having a plurality of compartments formed therein, each compartment containing one or two keys, said key being attached within said compartment by a key chain of relatively long length, said key chain being secured to an interior surface of said housing;

a plurality of doors attached to said hollow housing and operable to selectively cover openings associated with said compartments, each of said doors allowing access to one of said compartments so that said keys may be selectively and exclusively removed from said compartment;

a removably attached clip secured to an attachment region on said rear panel, said attachment region capable of being secured to a variety of different surfaces.

7. The assembly of claim 6 including indicia for enumerating said slots.

8. The assembly of claim 7 including means for illuminating said indicia.

9. The assembly of claim 1 including a removably attached clip secured to an attachment region on said rear panel, said attachment region capable of being secured to a variety of different surfaces.

10. The assembly of claim 1 including an externally attached key ring.

11. The assembly of claim 1 including an externally attached belt loop.

12. A key case assembly for storing a plurality of keys so that any one key may be selectively extended therefrom comprising:

a generally hollow housing having a top, a pair of opposing side panels, a bottom panel, and a rear panel;

said hollow housing having a plurality of compartments formed therein, each compartment containing at least one key, said at least one key being attached within said compartment by a connector of relatively long length;

a plurality of pairs of overlapping flaps, each of said pairs allowing access to one of said compartments so that said keys may be selectively and exclusively removed from said compartment;

a plurality of retainers corresponding to said plurality of compartments, said retainers capable of selectively retaining said connector within said compartments.

* * * * *